United States Patent [19]

Wilson

[11] 4,022,552

[45] May 10, 1977

[54] VANE TYPE FLUID POWER MACHINE

[76] Inventor: Donald G. Wilson, 4154 Stathmore Lane, San Antonio, Tex. 78217

[22] Filed: Mar. 17, 1976

[21] Appl. No.: 667,766

[52] U.S. Cl. ..... 418/37

[51] Int. Cl.[2] ..... F01C 1/00; F04C 17/00; F02B 55/14

[58] Field of Search ..... 418/33, 35, 37; 123/8.47

[56] References Cited

UNITED STATES PATENTS

| | | | |
|---|---|---|---|
| 3,724,428 | 4/1973 | Mederer | 418/33 |
| 3,746,480 | 7/1973 | Ryen | 418/37 |
| 3,776,202 | 12/1973 | Mesa | 418/36 |

FOREIGN PATENTS OR APPLICATIONS

| | | | |
|---|---|---|---|
| 588,778 | 2/1925 | France | 123/8.47 |

*Primary Examiner*—John J. Vrablik
*Attorney, Agent, or Firm*—Peter A. Taucher; John E. McRae; Nathan Edelberg

[57] ABSTRACT

A vane type fluid power machine wherein each vane has a cyclically varying rotational velocity, whereby the compartments formed between adjacent vanes are caused to sequentially expand and contract to produce pump or motor action. Cyclical vane speed changes are produced by unique crank-rotor assemblies associated with each vane unit.

11 Claims, 6 Drawing Figures

Fig-1
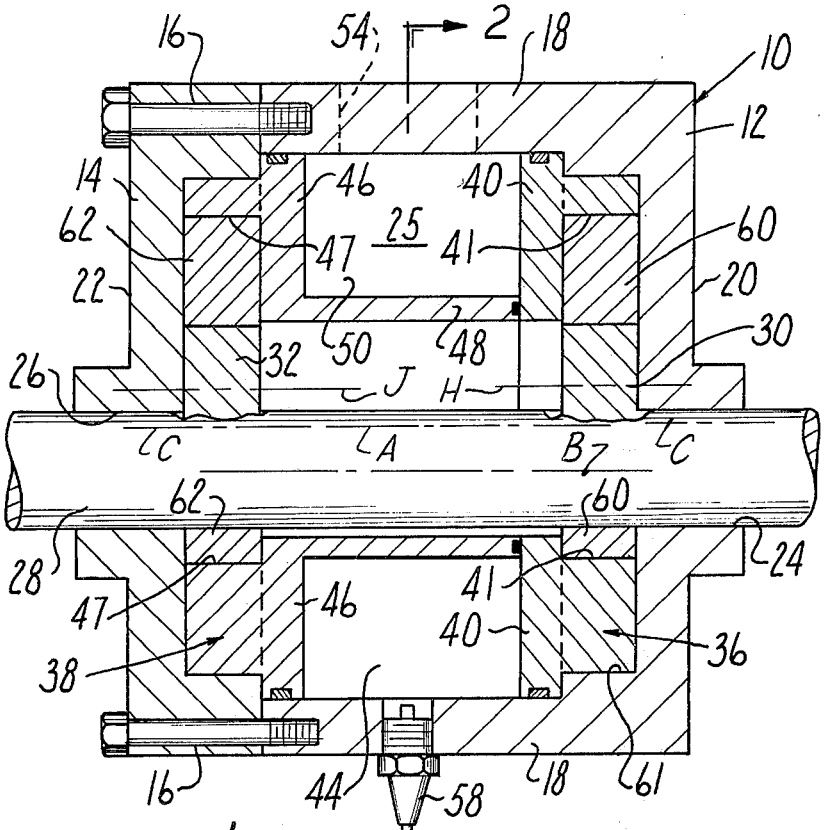
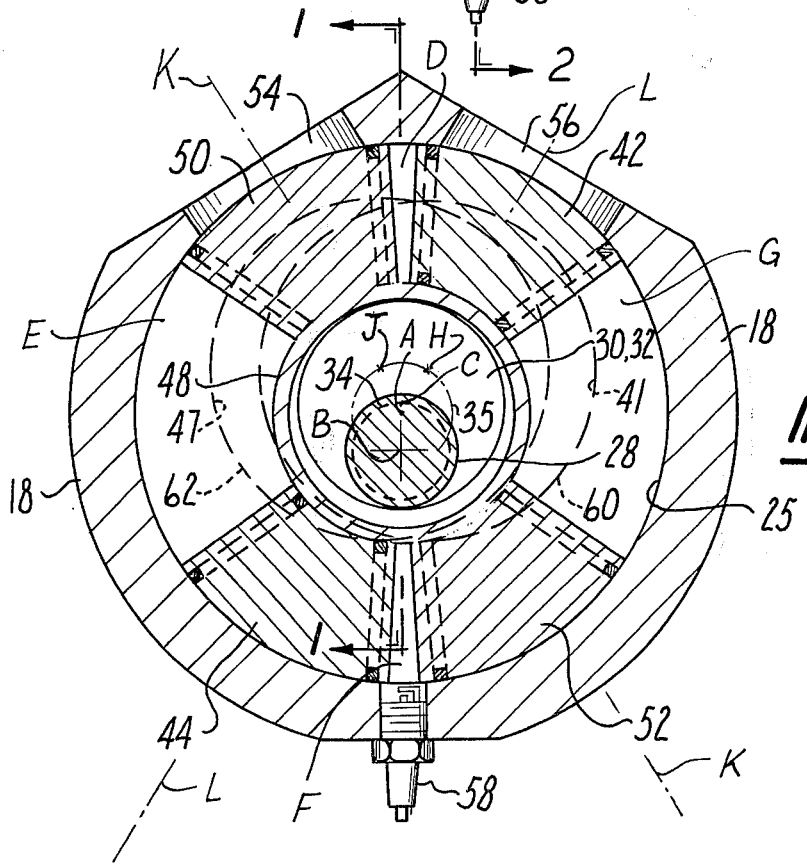
Fig-2

Fig-3
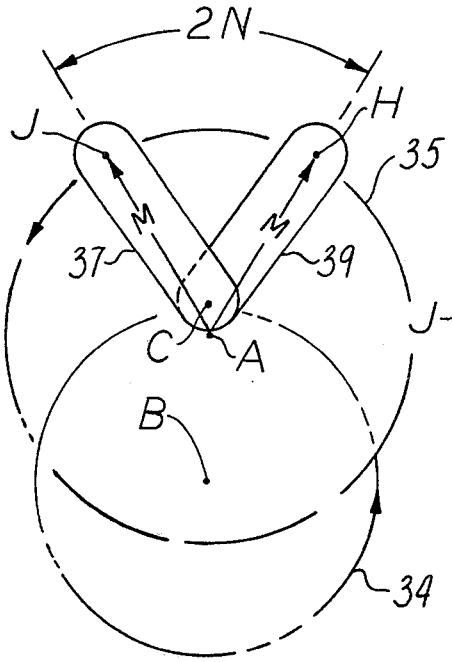
Fig-4
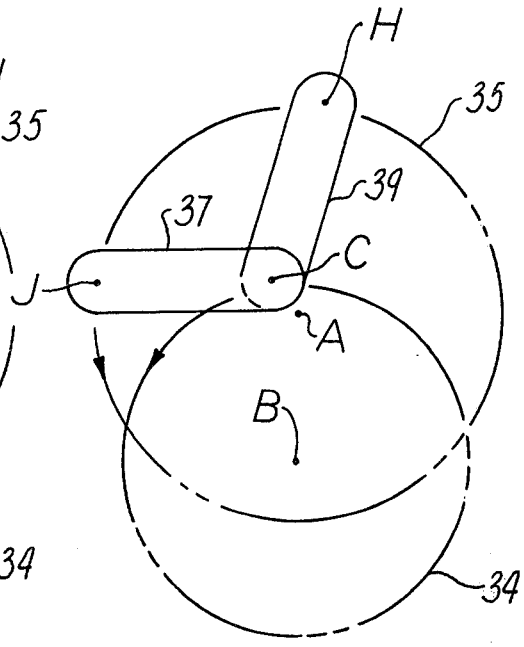
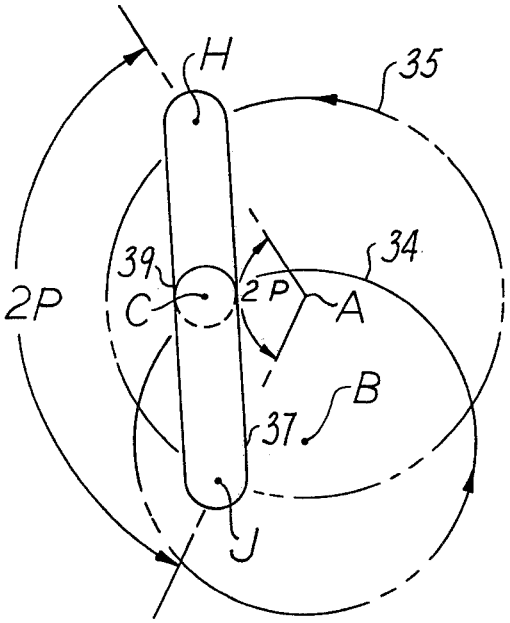
Fig-5
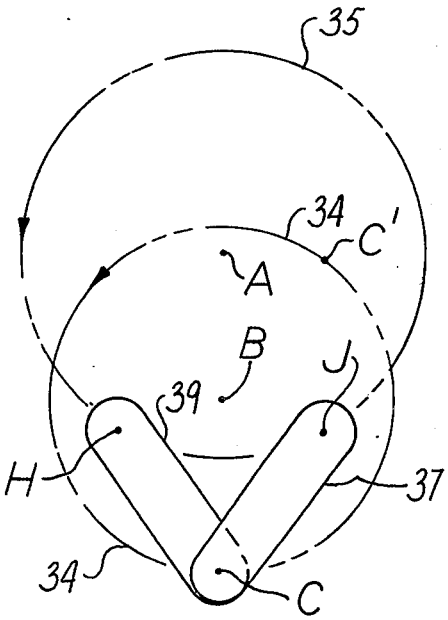
Fig-6

VANE TYPE FLUID POWER MACHINE

BACKGROUND AND SUMMARY OF THE INVENTION

Rotary vane type fluid power machines are shown in U.S. Pat. No. 3,463,128 issued to R. G. Spinnett, U.S. Pat. No. 3,776,202 issued to B. E. Mesa, U.S. Pat. No. 3,858,560 issued to J. A. Harrington, U.S. Pat. No. 3,890,939 issued to A. A. McIntosh. Presumably other patents not known to applicant have also issued on this machine.

The present invention relates to improved means for producing cyclical speed changes in the vanes of this type machine. An object of this invention is to provide a vane speed control mechanism employing circular rotors and crank pins that present large surface areas to the load, thereby improving the rigidity and service life of the machine. The invention is applicable to internal combustion engines, or fluid pumps, or fluid motors. For illustration purposes the attached drawings show the invention incorporated into an engine.

THE DRAWINGS

FIG. 1 is a cross sectional view taken through an engine incorporating the invention.

FIG. 2 is a sectional view taken on line 2—2 in FIG. 1.

FIGS. 3 through 6 diagrammatically illustrate cyclic movement of the vanes in the FIG. 1 engine.

GENERAL ARRANGEMENT

The attached drawings illustrate an internal combustion engine incorporating the invention. The engine includes two interconnected vane units rotatable within a circular chamber on the chamber axis so that explosion forces cause the leading vane unit to move away from the trailing vane unit, thereby providing a power stroke. The interconnection mechanism for the vane units comprises two circular rotors seated within circular recesses in the respective vane units for orbital motion around the chamber axis, and two circular crank pins seated within circular recesses in the rotors. The crank pins are carried by a single output shaft extending through the engine on an axis offset from the rotational axis of the vane units. During operation of the engine the rotating vane units cause the circular rotors to orbit around the vane rotational axis; the rotors also rotate around their individual centers. The rotors transmit rotational forces to the circular crank pins, which orbit around the axis of the output shaft.

The rotor-crank pin orbital paths are such that each vane unit has a variable velocity during its travel around the axis of the circular chamber. The rotors are displaced circumferentially from one another so that one vane unit is accelerating while the other vane is decelerating; and vice versa. In this manner the vane units are caused to approach and then recede from one another as they travel around the circular chamber.

DETAILED STRUCTURE

The engine shown in FIGS. 1 and 2 comprises a stationary housing 10 formed by two housing members 12 and 14 suitably joined together by a number of bolts or studs 16. Housing member 12 is a generally cup-shaped structure that includes an annular side wall 18 and transverse end wall 20. Housing member 14 defines a second end wall 22. The space between end walls 20 and 22 defines a circular working chamber 25 having a central horizontal axis A (FIG. 2).

Circular openings 24 and 26 in the housing end walls define bearings for a crank shaft 28 that extends entirely through the engine. A gear, pulley or other similar device (not shown) may be affixed to either exposed end of the shaft to deliver power to a driven mechanism, such as a vehicle transmission, electrical generator. etc. Note that axis B of the crank shaft is offset from axis A of working chamber 25.

Affixed to crank shaft 28 are two circular crank pins 30 and 32. Each crank pin has a circular outer surface circumscribed around an imaginary axis C (FIG. 2). Therefore as shaft 28 rotates around axis B the center of each crank pin orbits around a path traced by imaginary line 34. In the condition of FIG. 2 axis C is located directly above axes A and B; during operation of the engine crank pin axis C orbits along path 34, whereas axes A and B remain fixed in space.

Rotatably received within circular chamber 25 are two independently movable vane units 36 and 38. Vane unit 36 comprises a circular end wall 40 (FIG. 1) and two axially-extending segmental walls 42 and 44 (FIG. 2). Vane unit 38 comprises a circular end wall 46, an axially extending tubular wall 48 and two segmental walls 50 and 52. Walls 42, 44, 50 and 52 constitute vane type pistons that cyclically expand and contact the four intervening compartments designated by reference letters D, E, F, and G. In the condition of FIG. 2 compartments D and F are at minimum "top dead center" volume; compartments E and G are at maximum "bottom dead center" volume. Vane movement direction is counterclockwise as viewed in FIG. 2.

Combustion air or a combustible air-fuel mixture is delivered to the engine through an intake port 54. Products of combustion are exhausted through an exhaust port 56. Ignition is provided by a conventional spark plug 58 that is supplied with timed high voltage pulses by an electrical distributor, not shown. Combustion may take place in an external chamber, as shown for example in U.S. Pat. No. 3,857,369.

Operation of the engine requires that the vane units 36 and 38 be interconnected so that adjacent ones of the vanes, e.g., vanes 42 and 50, cyclically advance toward one another and retreat from one another as the two vane units 36 and 38 rotates in the counterclockwise direction. In the illustrated engine the necessary interconnection between vane units 36 and 38 is provided by crank shaft 28 and two spaced rotors 60 and 62. As seen in FIG. 2, the two rotors 60 and 62 are offset relative to one another; this ensures that when one of the vane units is accelerating the other vane unit is decelerating, and vice versa, throughout the engine cycle.

Each rotor 60 or 62 is a circular disk having an imaginary center H or J. Rotor 60 is swivel-mounted within a circular cavity 41 in end wall 40 of vane unit 36 (see FIG. 1). Rotor 62 is swivel-mounted within a circular cavity 47 in end wall 46 of vane unit 38. In each case the diameter of the cavity is the same as the diameter of the rotor so that the rotor can freely rotate around its axis H or J while the vane units are rotating around chamber axis A. The imaginary centers H and J of rotors 60 and 62 are located the same distance from chamber axis A so that during operation of the engine the rotor centers H and J orbit around axis A in a circular path designated by numeral 35. At the same time each rotor 60 or 62 swivels within the associated circular cavity of the connected vane unit 36 or 38.

It will be observed from FIG. 1 that each circular crank pin 30 or 32 is located within an associated rotor 60 or 62; each crank pin-rotor assembly is disposed in a common plane between the vane end wall and the housing end wall. The outer circular surface of each crank pin has swivel engagement with the surface of a circular opening in the associated rotor. The circular line joints between crank pins 30, 32 and rotors 60, 62 can be visualized as swivel connections that permit the crank pins to rotate relative to the rotors. Similarly the circular line joints between rotors 60, 62 and vane end walls 40, 46 can be visualized as swivel connections.

It will be seen from FIG. 1 that vane unit 36 is interconnected with vane unit 38 by a drive connection that comprises rotor 60, crank pin 30, crank shaft 28, crank pin 32, rotor 62, and end wall 46 of vane units 38. The axes A, B, C, J and H for these various components are offset or eccentric to one another so that explosion forces exerted on vanes 44 and 52 (by ignition means 58) tend to separate the vanes and at the same time move the vane units counterclockwise around chamber axis A. coincident with rotation of the vane units, the rotor center points H and J orbit around axis A along circular path 35; each rotor 60 or 62 swivels relative to its vane unit 36 or 38. Each crank pin 30 or 32 orbits around shaft axis B along circular path 34.

In general, each crank pin-rotor assembly serves as a drive connection between one of the vane units 36 or 38 and the output shaft 28. As each crank pin moves to a different position along path 34 it moves the "attached" rotor point J or H a different incremental distance; this means a variable rotational velocity of the associated vane unit for a given shaft 28 velocity. The swivel interconnections between the crank pins, rotors and vane units enable the crank pins and rotors to turn freely without applying undesired binding forces to the crank shaft or vane units.

DIAGRAMMATIC FIGS. 3 THROUGH 6

FIGS. 3 through 6 diagrammatically show the various centers A, B, C, J and H at different rotated conditions of the vane units 36 and 38. Centers A and B remain fixed in space at all times, center C orbits around axis B along path 34, and centers J ahd H orbit around central axis A along path 35. Centers C and J maintain a constant spacing; for visualization purposes these centers are shown connected by an imaginary link 37. Centers C and H also maintain a constant spacing; these centers are shown connected by an imaginary link 39. As center C moves along path 34 the center points J and H alternately move toward and away from each other.

Centers J and H lie on the radial centerlines K and L of their respective vane units 36 and 38 (see FIG. 2). Therefore movements of centers J and H (depicted by FIGS. 3 through 6) represent movements of the respective vane units, e.g. vanes 50 and 42. FIG. 3 corresponds to the minimum vane-separation "top dead center" condition of FIG. 2. Explosion force has no vane-separating effect until center C is slightly displaced counterclockwise from its FIG. 3 position along path 34. When such counterclockwise displacement occurs the explosion force moves center J counterclockwise as seen in FIG. 4. Clockwise explosion force on center H is prevented from moving center H in the clockwise direction because of the "overcenter" relationship of center points A, C and H. Thus, if AC is viewed as one link and CH is viewed as a second link, then the two links cooperatively produce an overcenter condition that effectively prevents clockwise motion of center H along path 35. Therefore the explosion force initially moves center point J and vane 52 counterclockwise along path 35 without producing an equivalent clockwise motion of center point H (and vane 44).

By comparing FIGS. 3 and 4 it will be seen that point J moves counterclockwise an appreciable distance, whereas point H moves counterclockwise a lesser distance. The difference in J, H point spacing (FIGS. 3 and 4) represents the vane separating distance, i.e., the expansion stroke. FIG. 5 illustrates the positions of center points J and H at the end of the expansion stroke. FIG. 6 illustrates the positions of center points J and H at the ensuing bottom dead center position, i.e., conclusion of the exhaust stroke (for vanes 52 and 44). As center points J and H for vanes 52 and 44 move counterclockwise from the FIG. 6 condition back to the FIG. 3 condition the vane spacing first increases (intake stroke) and then decreases (compression stroke). At the intervening top dead center position the center C is at location $C^1$ (FIG. 6).

It will be seen that during one complete revolution of crankshaft 28 (one orbit of point C around axis B) the two vanes 52 and 44 accomplish one complete engine cycle, i.e. expansion, exhaust, intake and compression. Meanwhile the other two vanes 50 and 42 are also accomplishing a similar cycle, comprising intake, compression, expansion and exhaust. The vane units collectively produce two complete cycles for one complete revolution of the crankshaft.

The explosion stroke from FIG. 3 to the FIG. 5 positions requires only about 35° travel of point C around axis B, whereas the explosion stroke depicted in FIG. 6 (movement of point C to location $C^1$) requires about 145° . Fuel mixture may be varied to achieve fast burn or slow burn operation.

To ensure the same clearance at each top dead center position (FIGS. 3 and 6) the various center distances AB, BC, CJ, etc. should be carefully selected. Assuming a given orbital distance M between points A and J (or A and H), a given minumum separation angle 2N (FIG. 3), and a given maximum separation angle 2P (FIG. 5), the distance between points A and B is determined as $M \sqrt{\sin^2 P - \sin^2 N}$. The orbiting distance between points B and C is determined as M Cos N. The distance between points C and J (or between C and H) is M Sin P.

The illustrated engine (FIGS. 2 through 6) is designed to have a minimum separation angle of 60° and a maximum separation angle of 120°; therefore in this case N is 30°, and P is 60°. Different values of N and P may be chosen or imposed by a variety of design considerations as long as the relationships expressed in the above equations are maintained.

FEATURES OF THE INVENTION

One feature of the invention is the circular nature of the various rotors 60, 62 and crank pins 30, 32 that lends the assembly to relatively close tolerance manufacture at relatively low machining costs. The circular elements have swivel connections defined by relatively large circular surface areas so that the loads are absorbed as relatively low unit area forces. Note particularly the large circular surface areas on rotors 60 and 62. By minimizing the unit area forces it is believed possible to minimize friction losses and to reduce wall thicknesses and total mass. The circular nature of the load surfaces contributes to low machining costs.

The illustrated machine is a double cycle rotary mechanism wherein two four-stroke cycles are produced during each complete revolution of the output shaft 28. This contrasts with other known rotary vane machines of comparable complexity wherein only one expansion-contraction cycle is produced. For a given rotational speed the volumetric displacement of this machine will be relatively large, thereby enabling a smaller machine to be used to satisfy a given requirement.

For optimum performance the combustion chambers (compartments) should be completely sealed from the atmosphere and from each other. Preferably the moving seals should be required to handle only the gas pressure forces, not mechanical forces imposed from one wall surface to another. In the illustrated engine axial thrust forces are absorbed by end walls 40, 20 and 46, 22. These walls have extensive radial surface areas; therefore the seals are relieved of mechanical stress. Similarly radial forces are absorbed by circumferential wall 18 which has an extensive surface area, thus relieving mechanical stress on the associated seals.

The illustrated machine is believed to have good balance, thereby minimizing vibration and uneven peak loadings which contribute to wear and bearing failure. The high mass components comprising vanes 42, 44, 52 and 54 are balanced relative to central rotation axis A. The centers for eccentric rotors 60 and 62 are relatively close to central axis A, thus minimizing vibration tendencies due to rotation of the off-center masses. Similarly the center for crank pins 30 and 32 is relatively close to rotational axis B. Additionally, the off-center masses have extensive bearing surfaces, thereby providing low unit area forces.

When component parts of the rotating assembly are constructed of materials having the same effective density the total machine is rotationally balanced. The masses of interest are the masses rotating about axis A, for example the rotors and crank pins. The shaft 28 rotates only about its own axis B and thus does not contribute any unbalancing effect. The components are not rotationally balanced when considered individually, but when the components are assembled the resultant machine is balanced.

I wish it to be understood that I do not desire to be limited to the exact details of construction shown and described for obvious modifications will occur to a person skilled in the art.

I claim:

1. A vane type fluid power machine comprising means defining a circular working chamber; first and second vane units independently movable within the working chamber for rotary motion around the chamber axis, the vanes in the respective units being interspersed so tha adjacent vanes form variable volume pressure compartments; a rotary power output crank shaft centered on a second axis parallel to, but eccentric from, the chamber axis; and a separate drive connection between the crank shaft and each vane unit, whereby each vane has a cyclically varying rotational velocity; each drive connection comprising a circular crank pin carried by the crank shaft, and a circular rotor floatably positioned between the respective crank pin and respective vane unit.

2. The fluid power machine of claim 1: each vane unit comprising a circular cam surface eccentric to the chamber axis; each rotor having a first circular drive surface swivelled on the associated crank pin and a second circular drive surface swivelled on the eccentric cam surface of the associated vane unit.

3. The fluid power machine of claim 1: the diameter of each circular crank pin being appreciably greater than the diameter of the crank shaft; the diameter of each circular rotor being appreciably greater than the diameter of each crank pin.

4. The fluid power machine of claim 1: each circular rotor having a circular opening therethrough of the same diameter as the associated crank pin, whereby the crank pin enjoys a swivel relationship to the rotor; the axis of each crank pin being eccentric to the axis of the crank shaft; the axis of the circular rotor being eccentric to the chamber axis; the crank pin axis and rotor axis being non-coincident.

5. The fluid power machine of claim 1: the axes of each rotor and each crank pin being non-coincident so that the crank pin orbits around the crank shaft axis while the rotor orbits around the chamber axis; each rotor and associated crank pin having swivel connections with one another to permit simultaneous orbiting movements thereof around different axes.

6. The fluid power machine of claim 1: the spacing between the crank pin axis and each rotor axis being at all times less than the orbital radius measured from the chamber axis to the rotor axis, whereby the crank pin at all times exerts a turning force on the rotor around the rotor axis.

7. The fluid power machine of claim 1: the crank shaft axis being spaced from the chamber axis by a distance $M \sqrt{\sin^2 P - \sin^2 N}$ where M represents the spacing of each rotor center from the chamber axis, 2P represents the maximum separation angle of the vane units, and 2N represents the minimum separation angle of the vane units; the crank shaft axis being spaced from the crank pin axis by a distance N Cosine N; the crank pin axis being spaced from the axis of each rotor by a distance M Sin P.

8. The fluid power machine of claim 1: each vane unit having a circular cavity eccentric to the chamber axis; each circular rotor being floatably swivelled within one of the associated cavities; each rotor having a circular opening therein swivably engaging the associated crank pin.

9. The fluid power machine of claim 8: the circular opening in each rotor being eccentric to the cavity axis; the crank pin axis being eccentric to the crank shaft axis.

10. The fluid power machine of claim 1: the circular working chamber being defined in part by spaced stationary end walls extending normal to the chamber axis; the crank shaft extending through the end walls and the intervening chamber on an axis eccentric to the chamber axis; said end walls defining bearings for the crank shaft.

11. The fluid power machine of claim 10: each crank pin-rotor assembly being located in a common plane between one of the stationary end walls and one of the vane units.

* * * * *

UNITED STATES PATENT OFFICE

CERTIFICATE OF CORRECTION

Patent No. 4,022,552 Dated May 10, 1977

Inventor(s) Donald G. Wilson

It is certified that error appears in the above-identified patent and that said Letters Patent are hereby corrected as shown below:

Column 1, line 5, should read --- The invention described herein may be manufactured, used and licensed by or for the Government for governmental purposes without payment to me of any royalty thereon. ---

Column 2, line 27, "contact" should read --- contract ---.

Column 2, line 47, "rotates" should read --- rotate ---.

Column 3, line 24, "coincident" should be capitalized.

Column 5, line 59, "tha" should read --- that ---.

Column 6, line 42, "N Cosine N" should read --- M Cosine N ---.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*